US010222085B2

(12) United States Patent
Heberer et al.

(10) Patent No.: US 10,222,085 B2
(45) Date of Patent: Mar. 5, 2019

(54) ENERGY RECOVERY VENTILATOR WITH REDUCED POWER CONSUMPTION

(71) Applicant: Carrier Corporation, Farmington, CT (US)

(72) Inventors: Dwight H. Heberer, Brownsburg, IN (US); Daniel J. Dempsey, Carmel, IN (US); Kevin D. Thompson, Indianapolis, IN (US); Eric W. Adams, Manlius, NY (US); Kent Kuffner, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 1145 days.

(21) Appl. No.: 13/778,305

(22) Filed: Feb. 27, 2013

(65) Prior Publication Data

US 2013/0225060 A1 Aug. 29, 2013

Related U.S. Application Data

(60) Provisional application No. 61/604,559, filed on Feb. 29, 2012.

(51) Int. Cl.
*F24F 11/00* (2018.01)
*F24F 11/77* (2018.01)

(52) U.S. Cl.
CPC ..... *F24F 11/77* (2018.01); *F24F 11/0001* (2013.01)

(58) Field of Classification Search
CPC ..... F24F 11/00
USPC ..... 454/256
See application file for complete search history.

(56) References Cited

U.S. PATENT DOCUMENTS

| | | | | |
|---|---|---|---|---|
| 3,855,814 | A | 12/1974 | Eubank | |
| 3,991,819 | A | 11/1976 | Clark | |
| 4,048,811 | A | 9/1977 | Ito et al. | |
| 4,062,400 | A | 12/1977 | Horowitz | |
| 4,079,888 | A | 3/1978 | Briscoe | |
| 4,149,590 | A | 4/1979 | Ospelt | |
| 4,285,390 | A | 8/1981 | Fortune et al. | |
| 4,323,369 | A | 4/1982 | Monson et al. | |
| 4,443,723 | A | 4/1984 | Ohkubo | |
| 4,478,274 | A * | 10/1984 | Naganoma | B60H 1/00971 165/202 |

(Continued)

FOREIGN PATENT DOCUMENTS

| | | |
|---|---|---|
| CA | 2588628 | 11/2008 |
| GB | 2143026 A | 1/1985 |

(Continued)

OTHER PUBLICATIONS

Breeze by RenewAire LLC, Installation and Operation Manual, Model BR70/BR130, Feb. 2009; pp. 1-8.

(Continued)

*Primary Examiner* — Steven B McAllister
*Assistant Examiner* — Samantha Probst
(74) *Attorney, Agent, or Firm* — Cantor Colburn LLP

(57) ABSTRACT

An air conditioning unit includes a passage having a heat exchanger; a blower for blowing air through the passage; a blower motor driving the blower in response to a drive signal; an energy recovery ventilator (ERV), the blower drawing outside air from the ERV; and a controller for adjusting the drive signal in a ventilation mode to reduce power used by the blower motor.

6 Claims, 3 Drawing Sheets

(56) References Cited

U.S. PATENT DOCUMENTS 4,495,560 A * 1/1985 Sugimoto ..... B60H 1/00814 137/624.11
4,513,809 A 4/1985 Schneider et al.
4,549,362 A * 10/1985 Haried ..... D06F 58/263 34/395
4,584,511 A * 4/1986 Rudich, Jr. ..... G05D 3/14 318/12
4,637,386 A 1/1987 Baum
4,667,480 A * 5/1987 Bessler ..... B60H 1/3205 318/254.1
5,273,210 A 12/1993 Pender et al.
5,285,842 A 2/1994 Chagnot
5,348,077 A 9/1994 Hillman
5,439,415 A 8/1995 Hirikawa et al.
5,492,273 A 2/1996 Shah
5,722,887 A 3/1998 Wolfson et al.
5,791,408 A 8/1998 Seem
5,855,320 A 1/1999 Grinbergs
5,943,878 A 8/1999 Smiley, III et al.
6,038,879 A 3/2000 Turcotte et al.
6,155,074 A 12/2000 Jung et al.
6,169,849 B1 1/2001 Schmidt
6,170,271 B1 1/2001 Sullivan
6,347,527 B1 2/2002 Bailey et al.
6,385,983 B1 5/2002 Sakki et al.
6,386,460 B2 5/2002 Riley et al.
6,431,127 B2 8/2002 Weber
6,434,968 B2 8/2002 Buchholz et al.
6,481,635 B2 11/2002 Riley et al.
6,514,138 B2 2/2003 Estepp
6,604,688 B2 8/2003 Ganesh et al.
6,619,063 B1 9/2003 Brumett
6,637,232 B1 10/2003 Harshberger et al.
6,694,769 B2 2/2004 Pelleter et al.
6,742,516 B2 6/2004 McCarren
6,745,579 B2 6/2004 Spinazzola et al.
6,855,050 B2 2/2005 Gagnon et al.
6,860,112 B1 3/2005 Kobayashi et al.
6,868,693 B2 3/2005 Choi et al.
6,874,334 B2 4/2005 Kim et al.
6,986,386 B2 1/2006 Sekhar et al.
6,990,825 B2 1/2006 Hansen
7,013,950 B2 3/2006 Steneby et al.
7,036,560 B1 5/2006 Rylewski
7,044,397 B2 5/2006 Bartlett et al.
7,073,566 B2 7/2006 Lagace et al.
7,075,255 B1 * 7/2006 Gambiana ..... H02P 25/16 318/66
7,097,111 B2 8/2006 Riley et al.
7,121,110 B2 10/2006 Yum et al.
7,168,126 B2 1/2007 Biere
7,191,615 B2 3/2007 Lee et al.
7,299,122 B2 * 11/2007 Perkins ..... F02B 29/0481 123/563
7,322,401 B2 1/2008 Kim
7,461,511 B2 12/2008 Kim et al.
7,621,147 B2 11/2009 Schilling
7,798,418 B1 9/2010 Rudd
7,802,443 B2 9/2010 Wetzel
7,942,193 B2 5/2011 Caldwell
7,997,328 B2 8/2011 Kim et al.
8,020,396 B2 9/2011 Kodeda
8,373,378 B2 * 2/2013 Steiner ..... H02M 5/297 318/727
8,702,482 B2 * 4/2014 Helt ..... F24F 11/0001 236/49.3
9,500,386 B1 * 11/2016 Walsh ..... F24H 9/2071
2003/0030408 A1 * 2/2003 Ratz ..... F23N 1/062 318/772
2003/0139133 A1 * 7/2003 Hardy ..... F24F 7/10 454/290
2005/0119766 A1 6/2005 Amundson et al.
2005/0133204 A1 6/2005 Gates et al.
2005/0236150 A1 * 10/2005 Chagnot ..... F24F 12/006 165/222
2006/0114637 A1 * 6/2006 Ashworth ..... B01D 53/32 361/230
2006/0151165 A1 7/2006 Poirier
2006/0162552 A1 7/2006 Yost et al.
2006/0172687 A1 8/2006 Vroege
2007/0012052 A1 * 1/2007 Butler ..... F24F 11/0009 62/181
2007/0205297 A1 * 9/2007 Finkam ..... F24F 11/001 236/1 C
2007/0289322 A1 12/2007 Mathews
2008/0000630 A1 1/2008 Haglid
2008/0230206 A1 9/2008 Lestage et al.
2010/0015906 A1 1/2010 Takahashi et al.
2010/0044448 A1 2/2010 Wolfson
2010/0065245 A1 3/2010 Imada et al.
2011/0017427 A1 1/2011 Kato et al.
2011/0036541 A1 2/2011 Takada et al.
2011/0061832 A1 3/2011 Albertson
2011/0100043 A1 5/2011 Matubara et al.
2011/0114739 A1 * 5/2011 Misumi ..... B60H 1/00742 236/49.3
2011/0146941 A1 * 6/2011 Benoit ..... F24F 12/006 165/11.1
2011/0247620 A1 * 10/2011 Armstrong ..... A61M 16/10 128/204.23
2012/0253526 A1 * 10/2012 Storm ..... F24F 11/0079 700/278
2013/0090769 A1 * 4/2013 McKie ..... F24F 11/006 700/277
2013/0105104 A1 * 5/2013 Wiley ..... F24F 3/147 165/8
2013/0158719 A1 * 6/2013 McKie ..... F24F 11/006 700/276
2013/0180700 A1 * 7/2013 Aycock ..... F24F 11/0001 165/248
2017/0045255 A1 * 2/2017 Karamanos ..... G05D 7/0635
2017/0115025 A1 * 4/2017 Mowris ..... F24H 9/2064
2017/0268797 A1 * 9/2017 Mowris ..... F24H 9/2071

FOREIGN PATENT DOCUMENTS

GB 2228079 A 8/1990
JP 57157959 A 9/1982
JP 58047942 A 3/1983
JP 58193036 A 11/1983
JP 62169950 A 7/1987
JP 63180030 A 7/1988
JP 3158633 A 7/1991
JP 10089736 A 9/1996
JP 10089738 A 4/1998
JP 11023025 A 1/1999

OTHER PUBLICATIONS

Canada Mortgage and Housing Corporation; Innovative Buildings; "Multi Residential Natural Resource Conservation and Energy Efficiency", Nov. 10, 2006.; p. 1-6 (see p. 4—diagram—Ventilation Space Conditioning System Schematic (VSC).

Nu-Air Ventilation Systems, Inc., ENERBOSS Advanced design, efficient performance, Brochure Apr. 2008, 2 pages.

Venmar Ventiliation Inc., Energy Efficient Fresh Air System, Installation Instructions for Residential Use Only., 07959 Rev. G.

Venmar Ventilation Inc., Enerflo, The energy efficient fresh air system; Brochure, Apr. 2007—4 pages.

Vanmar Ventilation Inc., Furnace Air Exchanger with Heat Recovery, Installation and User Manual, 04423, May 15, 2002, pp. 1-14.

Venmar Ventilation Inc., Furnace Air Exchanger with Heat Recovery Models; FAE125 and FAE125M, Installation and User Manual; 09219 rev. 01, pp. 1-14.

Le MiniClim De Technolclim Inc., "Un Minisysteme Central De Climatisation Efficace, Compact Et Abordable," Nov.-Dec. 2010; p. 18-19.

(56) References Cited

OTHER PUBLICATIONS

Canada Mortgage and Housing Corporation, Research Highlights, Technical Series 04-105, "Field Testing of an Integrated Ventilation Space Conditioning System for Apartments"; Jan. 2004, 6 pages.
Airia Brands Inc., Ventmax IVS Integrated Vertical Stack, 98-IVS (Jul. 2010).
John Eakes, Home Improvement Tips & Techniques—Article 625: "HRV—both supply and exhaust ducted to furnace. Is this a good idea?" Dec. 21, 2000—2 pages.
Airia Brands Inc. with Aircom Electronics: "LifeBreath, Clean Air Furnace" Installation Manual, Version CAF-02F-MB, pp. 1-47.
NY Thermal Inc., "The Matrix Total Home System" Brochure, Jun. 16, 2008, 4 pages.
Venmar, Product Sheet for Venmar AVS Enerflo Part No. NRFLOH-ND, Energy Efficient Fresh Air System, Sep. 2009—1 page.
Unilux V.F.C. Corp., Unilux Fan Coil Capacity Schedule for DLE350-HRV75—DLE1000-HRV75 Capacity Schedule.—1 page.
Unilux V.F.C. Corp., "Unilux VFC Integrated With HRV", Regent Block 24, submitted to University Plumbing, Toronto, Ontario on Dec. 3, 2010; 17 pages.
Parent, et al., Building Simulation; "Modelling of an Advanced Integrated Mechanical System for Residential Applications"; Rio de Janiero, Brazil, Aug. 13-15, 2001; pp. 279-286.
Unilux V.F.C. Corp., Unilux Fan Coil Capacity Schedule for DLE350-ERV75—DLE1000-ERV75 Capacity Schedule—1 page.

* cited by examiner

ENERGY RECOVERY VENTILATOR WITH REDUCED POWER CONSUMPTION

CROSS-REFERENCE TO RELATED APPLICATIONS

This application claims the benefit of U.S. provisional patent application Ser. No. 61/604,559 filed Feb. 29, 2012, the entire contents of which are incorporated herein by reference.

BACKGROUND OF THE INVENTION

The subject matter disclosed herein generally relates to energy recovery ventilators, and in particular to a method and system for controlling an energy recovery ventilator to reduce power consumption and provide energy savings.

Energy recovery ventilators (ERVs) are used to provide fresh air circulation to a location. Fresh air circulation is particularly helpful in homes that are well sealed and highly insulated. Existing residential ERV's often require the furnace or air handler blower to run during ventilation mode because the fresh air delivery is done through the main air duct system for the home. During heating and cooling cycles there is no additional cost for ventilation because the blower runs during the heating and cooling cycles. However, during heating and cooling off cycles, running the blower for ventilation results in a higher energy cost for fresh air delivery because of the need to run the blower at full speed solely for ventilation.

BRIEF DESCRIPTION OF THE INVENTION

One embodiment is an air conditioning unit including a passage having a heat exchanger; a blower for blowing air through the passage; a blower motor driving the blower in response to a drive signal; an energy recovery ventilator (ERV), the blower drawing outside air from the ERV; and a controller for adjusting the drive signal in a ventilation mode to reduce power used by the blower motor.

Another embodiment is a ventilation system including an energy recovery ventilator (ERV) for fluid communication with a blower, the blower drawing outside air from the ERV in response to a drive signal applied to a blower motor; and a controller for adjusting the drive signal in a ventilation mode to reduce power to the blower motor.

DETAILED DESCRIPTION OF THE INVENTION

Figure 1:
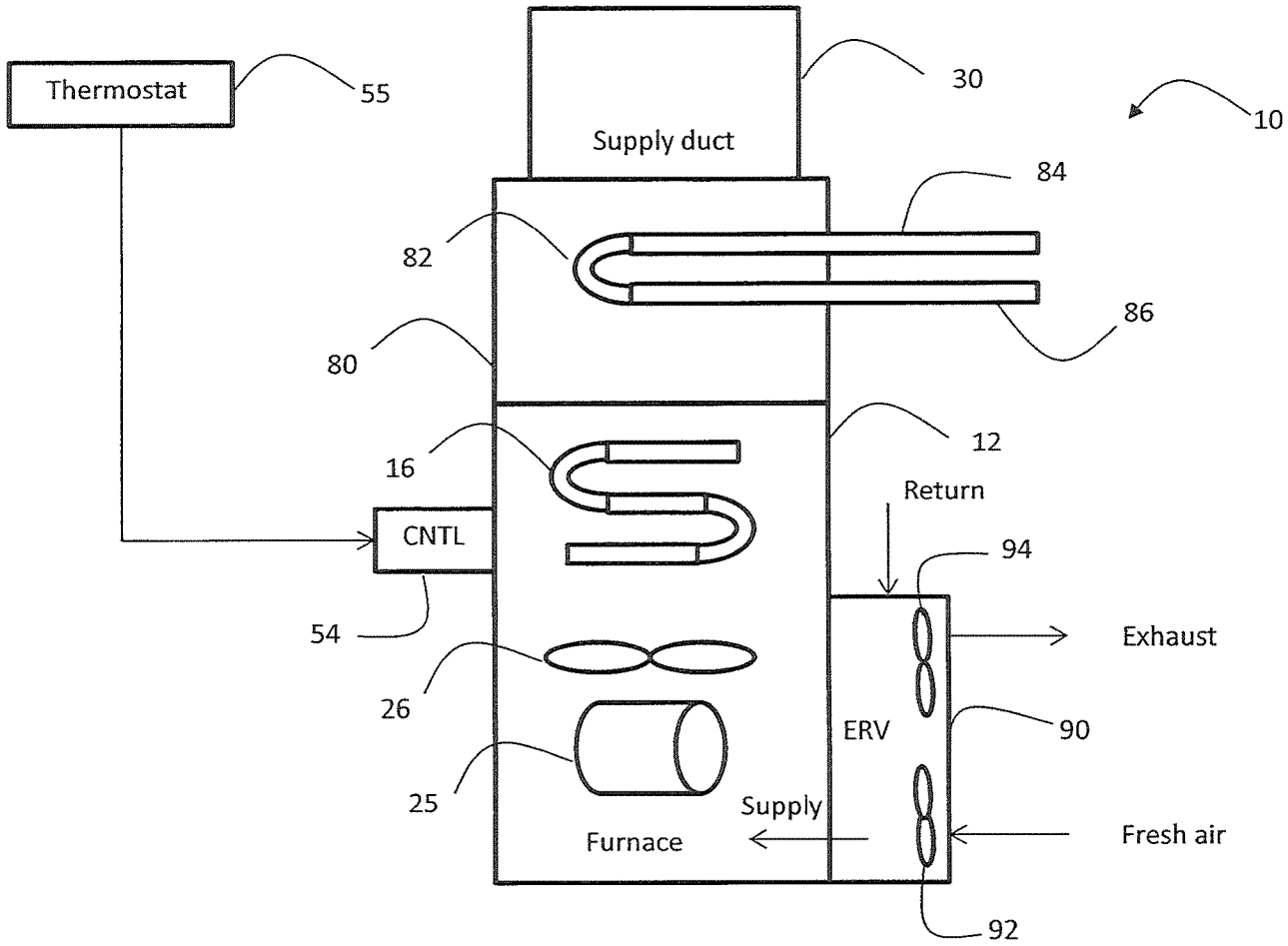
FIG. 1 depicts an exemplary air conditioning unit.

Referring to FIG. 1, numeral 10 generally designates an air conditioning unit having a furnace, an evaporator coil and an energy recovery ventilator (ERV). The ERV is described herein with reference to a gas furnace, but it is understood that the ERV (and control thereof) may be used with other systems, such as residential air handlers, and embodiments are not limited to a gas fired furnace as shown in FIG. 1. Air conditioning unit, as used herein, is intended to cover a variety of air handling equipment.

Air conditioning unit 10 includes a cabinet 12 housing therein furnace having a circulating air blower 26 driven by a blower motor 25. In heating mode, a heat exchanger 16 heats air circulated by air blower 26, which is supplied to a supply duct 30. A burner assembly, igniter, gas source, etc. are not shown for ease of illustration. An evaporator coil 82 is located in housing 80 on top of cabinet 12 and is the evaporator of a cooling unit. The evaporator coil 82 has an inlet 84, where subcooled refrigerant enters, and an outlet 86, where superheated refrigerant leaves, as is conventional. In cooling mode, evaporator coil 82 cools air circulated by air blower 26, which is supplied to a supply duct 30.

Cabinet 12 also houses a controller 54. Controller 54 may be implemented using a microprocessor-based controller executing computer program code stored on a computer readable storage medium. A thermostat 55 communicates with controller 54 to designate operational modes and temperature. Thermostat 55 may be an intelligent device that communicates requested air flow rates.

An energy recovery ventilator (ERV) 90 is mounted to a side of cabinet 12, but may be mounted in other locations. ERV 90 includes a fan 92 that draws fresh air from outside the building and uses energy from return air to precondition the outside air prior to distribution to cabinet 12. ERV 90 may be any existing type of ERV, such as a rotary heat exchanger (e.g., wheel) or plate heat exchanger with a membrane. ERV 90 may be arranged in cross-flow or counter-flow configuration. As used herein, ERV includes heat recovery ventilators (HRV), unless indicated otherwise.

Blower 26 is used to circulate supply air from ERV 90, through cabinet 12 and on to supply duct 30. Blower 26 also draws return air from location ducts back to the ERV 90 for energy recovery. ERV 90 includes an exhaust fan 94 for discharging exhaust air.

In embodiments of the invention, blower motor 25 is driven in a ventilation mode to reduce power consumption and still meet desired ventilation needs. In operation, thermostat 55 designates a mode such as low heat, high heat, low cool, high cool or ventilation. In ventilation mode, neither heating nor cooling is provided by air conditioning unit 10.

Control of blower motor 25 in ventilation mode may be accomplished in a variety of manners, depending on the type of blower motor 25. The goal is to reduce power to blower motor 25 while still meeting applicable ventilation requirements for the space being served.

Figure 2:
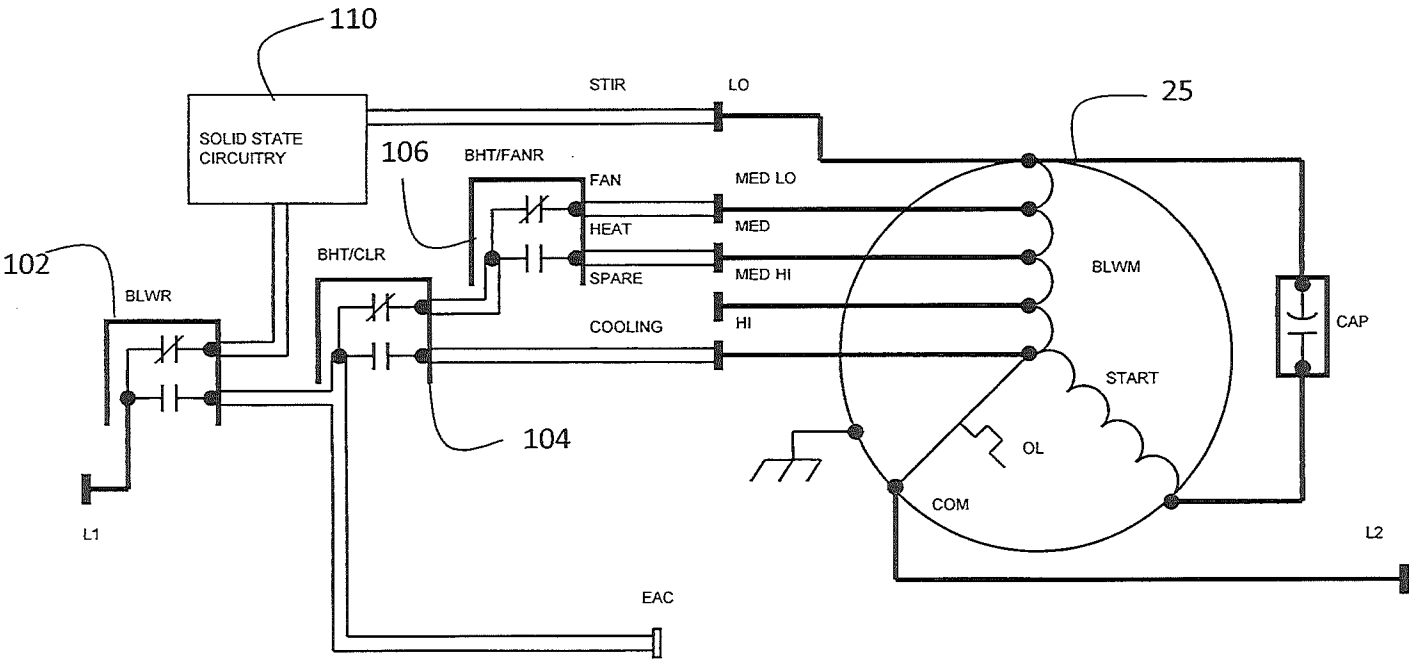
FIG. 2 depicts a motor and control circuitry in an exemplary embodiment.

In exemplary embodiments, blower motor 25 is a permanent split capacitor (PSC) motor having multiple taps. The motor speed is controlled by applying an AC voltage (e.g., 115 VAC or 220 VAC) to a particular tap to achieve a desired motor speed. FIG. 2 illustrates an exemplary embodiment where blower motor 25 is a PSC motor having 5 taps, corresponding to fan speeds of low, medium-low, medium, medium-high and high.

AC voltage is applied at inputs L1 and L2 and relays 102, 104 and 106 are used to form a path from input L1 to one of the medium-low, medium, and high taps. The medium-high tap is not terminated as a spare. Relays 102, 104 and 106 have contacts rated as high as 20 amps.

The low tap is used in ventilation only mode (i.e., no heating or cooling demand) referred to in FIG. 2 as a stir cycle. In this ventilation mode, blower motor 25 operates at a lower speed, which results in power savings. A solid state switching device 110 is used to provide voltage to the low speed tap. Other types of switching devices (e.g., relays) may be used. Solid state switching device 110 may operate in response to commands from controller 54. Solid state switching device 110 may be activated when the system is operating in an idle state. Relay 102 connects input voltage L1 to solid state switching device 110. This diverts power from the electric air cleaner (EAC) that is typically run during heating and cooling modes.

Solid state switching device 110 may be triggered at zero crossing points of input voltage L1 to reduce in-rush current to blower motor 25. Logic in solid state switching device 110 implements the stir cycle when the blower is transitioning out of a heating, or cooling state.

FIG. 2 represents one exemplary blower motor 25. Embodiments of the invention may be used with other types of motors, such as discreet tap X13 motors. These motors are driven by, e.g., 24 VAC, and are supplied with 3 to 5 taps. These taps draw low current (less than 15 ma) and can also be driven with DC voltage. Existing systems switch these taps on and off with relays that have gold contacts for low current circuits. If blower motor 25 is a discreet tap X13 motor, a system of relays and solid state circuitry similar to FIG. 2 may be used to provide voltage to a low speed tap to run the motor 25 in the ventilation or stir mode, and reduce energy consumption.

Figure 3:
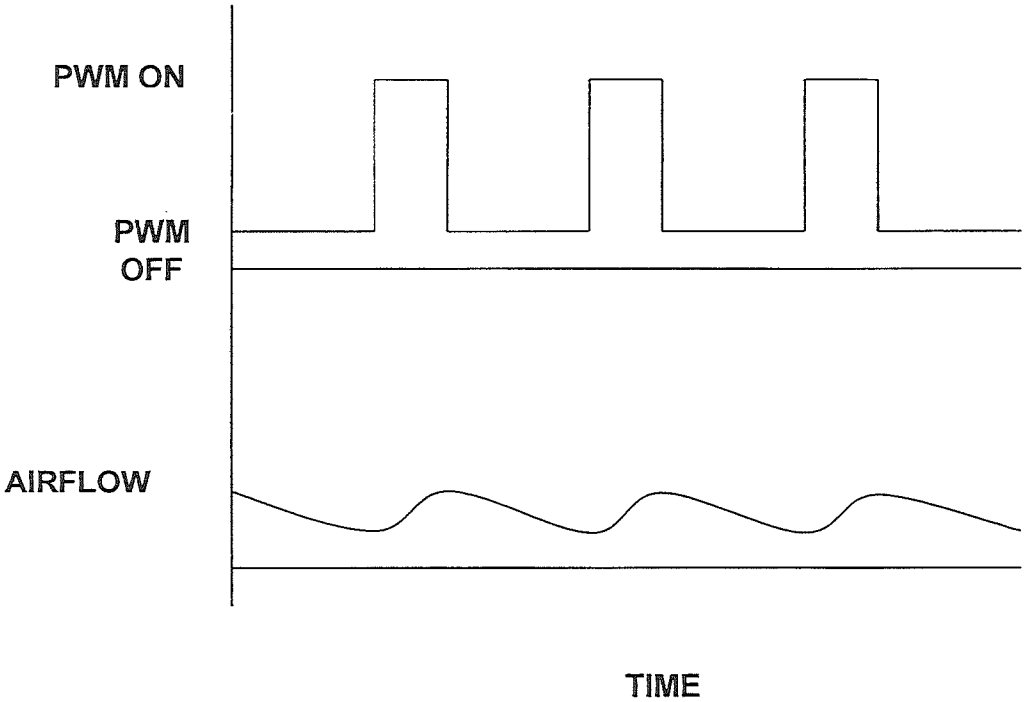
FIG. 3 depicts PWM on and off time along with airflow on the same time scale.

Another type of blower motor 25 that may be used in exemplary embodiments is a pulse width modulated (PWM) X-13 motor. These motors are driven with a PWM signal, which may be provided by controller 54. The PWM signal is, for example, between 80 hz and 120 hz, and causes the blower motor torque to vary with the percent duty cycle of the signal. Maximum motor torque will occur at 99% duty cycle and off will occur at a duty cycle of 0.4% or less. To activate the ventilation or stir mode, controller 54 generates an on PWM signal (having 1%-99% duty cycle) for a few seconds followed by an off PWM for a few seconds. FIG. 3 shows the on and off PWM signals, along with the airflow generated. It is understood that during the on PWM time, controller 54 is providing the PWM signal, made up of a series of pulses, to blower motor 25. During the off PWM time, no PWM signal is provided to blower motor 25. In exemplary embodiments, the on time may be 1 to 2 seconds and the off time may be 2 to 4 seconds OFF. The on PWM time and off PWM time may be dependent upon blower fan 26 inertia. By selectively applying the PWM signal, a lower motor RPM is achieved, meeting the airflow demands in ventilation mode and reducing energy consumption.

Another type of motor 25 that may be used in exemplary embodiments is a communicating electrically commutated motor (ECM) motor. In these embodiments, controller 54 controls blower motor 25 by transmitting digital communication commands. For example, a low motor RPM (e.g., just below 200 RPM) may be achieved by controller 54 sending a very low torque command, for example, 0-200. To achieve full motor torque, controller 54 sends a torque command of, for example, 65535. If the low torque command from controller 54 still results in too high of a motor RPM for the stir mode, then the torque command may be pulsed on and off, similar to the PWM on and off discussed above with reference to FIG. 3.

Driving the blower motor 25 to a low RPM in ventilation mode results in an energy savings when compared to existing units that drive the blower motor 25 at full speed during ventilation mode. Typical controls for ERV's and HRV's include timers for run time and wall controls to call for ventilation when needed. By ventilating continuously and employing the energy saving cycle, energy is saved and makes the timers and wall controls unnecessary. Cycling power to the blower during the ventilation mode at a prescribed rate also takes advantage of rotating blower inertia in order to stir the air sufficiently to deliver fresh air through the main air duct system to accomplish ventilation for the home but save on energy cost over running the main system blower solely for ventilation, especially with electronically commutated motors (ECM). The ventilation mode is also sufficient to prevent mixing of the supply and exhaust air streams from the ERV.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air conditioning unit comprising:
- a cabinet having a heat exchanger;
- a blower for blowing air through the cabinet;
- a blower motor driving the blower in response to a drive signal; the blower motor comprising multiple taps corresponding to a motor speeds;
- an energy recovery ventilator (ERV), the blower drawing outside air from the ERV; and
- a controller for controlling the drive signal comprising:
  - a ventilation mode wherein the drive signal is adjusted to a reduced power motor speed, energizing a low speed tap of the blower motor;
  - and a heating or cooling mode wherein the drive signal is adjusted to a tap other than the low speed tap to provide a power to achieve an increased motor speed other than the reduced power motor speed.

2. The air conditioning unit of claim 1 wherein: the controller meets a desired airflow through the passage.

3. The air conditioning unit of claim 1 further comprising: a switching device coupled to receive AC voltage and apply the AC voltage to the low speed tap.

4. The air conditioning unit of claim 3 wherein: the switching device applies the AC voltage to low speed tap in response to the controller.

5. The air conditioning unit of claim 1 wherein: the blower motor is a permanent split capacitor motor.

6. The air conditioning unit of claim 1 wherein: the blower motor is a discreet tap X13 motor.

* * * * *